US005243391A

United States Patent [19]

Williams et al.

[11] Patent Number: 5,243,391

[45] Date of Patent: Sep. 7, 1993

[54] VARYING AN ELECTRIC FIELD, DURING DEVELOPMENT OF A LATENT ELECTROSTATIC IMAGE WITH DEVELOPER SOLUTION, IN PROPORTION TO A SENSED CONCENTRATION OF TONER THAT IS WITHIN THE DEVELOPER SOLUTION

[75] Inventors: Tony Williams, St. Paul; Paul Erickson, Prior Lake; Stan Dorr, St. Paul, all of Minn.

[73] Assignee: Printware, Inc., St. Paul, Minn.

[21] Appl. No.: 876,974

[22] Filed: May 1, 1992

[51] Int. Cl.[5] ..... G03G 15/06; G03G 15/10

[52] U.S. Cl. ..... 355/256; 355/208; 355/261; 355/263; 355/265

[58] Field of Search ..... 355/203, 204, 208, 246, 355/261, 262, 263, 265, 256; 118/647, 648, 688, 689, 690

[56] References Cited

U.S. PATENT DOCUMENTS

| | | | |
|---|---|---|---|
| Re. 30,477 | 1/1981 | Gardiner et al. | 118/647 X |
| 3,892,481 | 7/1975 | Schaefer et al. | 355/256 X |
| 3,980,049 | 9/1976 | Tatsumi et al. | 355/203 X |
| 3,981,267 | 9/1976 | Gardiner et al. | 355/256 X |
| 4,050,806 | 9/1977 | Miyakawa et al. | 118/648 X |
| 4,129,375 | 12/1978 | Miyakawa et al. | 355/246 |
| 4,213,693 | 7/1980 | Imai et al. | 355/256 X |

FOREIGN PATENT DOCUMENTS

| | | | |
|---|---|---|---|
| 0029725 | 3/1978 | Japan | 118/688 |
| 3212659 | 9/1991 | Japan | 355/256 |

*Primary Examiner*—A. T. Grimley
*Assistant Examiner*—Matthew S. Smith
*Attorney, Agent, or Firm*—William C. Fuess

[57] ABSTRACT

The separation between two plates or electrodes—between which plates a developer solution is applied to develop a latent electrostatic charge image on a photoconductive medium within an electrophotographic imager—is varied in proportion to a detected concentration of toner within the developer solution. Resultantly to this control of the separation of the two plates, the proximity of the medium's photoconductive surface to a one plate, and the strength of the electric field between that plate and the photoconductive surface, is also controlled. By the control the thickness and density of the applied toner film is maintained constant, and a high quality image is maintained, despite depletion of toner from the developer solution. The toner concentration is preferably sensed as electrical resistance. A control circuit responsive to this sensed resistance preferably includes an analog-digital converter, a microprocessor, a stepper motor driver/controller, and a stepper motor rotating a cam. The cam rotation varies the separation between the two plates. The useful life of the developer solution for imaging is typically extended by a factor of at least two.

16 Claims, 7 Drawing Sheets

VARYING AN ELECTRIC FIELD, DURING DEVELOPMENT OF A LATENT ELECTROSTATIC IMAGE WITH DEVELOPER SOLUTION, IN PROPORTION TO A SENSED CONCENTRATION OF TONER THAT IS WITHIN THE DEVELOPER SOLUTION

BACKGROUND OF THE INVENTION

1. Field of the Invention

The present invention generally concerns electrophotographic imagers wherein a latent electrostatic charge image that has been optically formed on a photoconductive surface is developed by a developer solution that includes both a toner and a liquid carrier.

The present invention particularly concerns the production of a quality, and uniform, image in and by an electrophotographic imager regardless that the concentration of toner in the developer solution used by the imager should vary over time.

2. Description of the Prior Art

In electrophotographic imagers a latent electrostatic charge image is optically formed on a photoconductive surface, such as by the selective photoelectric discharge of certain regions of a charged photoconductive surface by a scanning laser light beam. The latent electrostatic charge image on the photoconductive surface is developed by a developer solution that includes both a toner and a liquid carrier. The developer solution, including the toner which is electrically conductive, is charged to an electrical voltage potential. When it is applied to the photoconductive surface upon which the electrostatic charge image has been formed, the toner is electrically attracted, and adheres, to the image region (only). The carrier portion of the developer solution is recycled. The developed image, typically upon the surface of a drum or a plate medium, may subsequently be used for contact printing.

In greater detail, a photoconductive surface of a plate or a drum medium is uniformly charged to a high voltage, typically several hundred volts. A latent electrostatic charge image is formed upon the photoconductive surface by selective discharge of regions of the surface by a light beam. The latent electrostatic charge image upon the medium's photoconductive surface remains charged to the high voltage, other regions are substantially discharged. The entire surface, including the regions thereof where the latent electrostatic charge image is present, passes proximately to a prime electrode that is charged to a voltage potential. It is at this location where the photoconductive surface is bathed in developer solution, electrostatically precipitating the toner from out of the developer solution to adhere to, and develop, the latent electrostatic charge image.

This voltage potential of the prime electrode is typically a few tens of volts. This voltage is intentionally made approximately equal to the latent voltage at the discharged regions of the photoconductive surface. Being so charged the prime electrode is still at several hundred volts potential difference from the region(s) of the photoconductive surface that are still charged, and where the latent electrostatic charge image exists.

The prime electrode that is charged to a few tens of volts is commonly constructed as one wall of an orifice, while a remaining wall portion of the orifice may be considered to constitute still another electrode. This remaining wall portion, or other electrode, is commonly at electrical ground. The orifice is typically in the shape of an elongate slot. The slot is as long as the medium is wide (typically eight inches or more), an inch or so in width, and of such thickness as provides a precision clearance on the order of a tenth of one inch (0.1") to a plate photoconductive medium that passes through it.

The nominal value of the electrostatic field that exists across the slot, and between its long walls, is some tens of volts magnitude, typically −25 v.d.c. In its regions that were depleted of charge (by an imaging optical laser beam that "writes white"), the photoconductive surface of the medium typically has a residual electrostatic charge of the same some tens of volts, or −25 v.d.c. Meanwhile, in the region(s) of the latent electrostatic charge image, the photoconductive surface of the medium typically has an electrostatic charge of some hundreds of volts, nominally −400 v.d.c. The side of the medium that is reverse to its photoconductive surface is typically metal (especially in the instance of a plate medium), and is typically at ground potential.

The medium having a selectively electrostatically charged photoconductive surface, meaning a surface that possesses a latent electrostatic charge image, is bathed, typically on both its sides, with liquid developer solution while in the presence of the prime electrode, and an electric field between itself and the prime electrode. Namely, this developer "bath" occurs where, and while, the medium passes proximately to the prime electrode, which is typically means through the slot, and within the (lessor}electric field of the slot.

The photoconductive surface of the medium faces the prime electrode which is, again, typically a side of the slot that is charged to a few tens of volts, nominally −25 v.d.c., voltage potential. Intentionally, and by adjustment, very little difference exists between this potential and the residual electrical potential of the charge-depleted regions of the photoconductive medium. Accordingly, only insignificant amounts of toner are electrostatically precipitated out of the developer solution onto these regions.

Conversely, the high voltage difference between the latent electrostatic charge image region(s) of the photoconductive surface and the side of the slot—nominally about −450 V.D.C. —(−25 v.d.c.) = −425 v.d.c.) causes a toner to be electrostatically precipitated (at a certain rate) out of the developer solution and onto this (these) region(s), blackening them. In other words, the regions of the photoconductive surface that were exposed by the (laser) light beam are "written write", and the unexposed regions were "left black" —although this can be reversed.

It is sometimes alternatively stated that the toner within the developer solution is "charged" to a voltage potential different that the latent electrostatic charge image region(s) of the photoconductive surface, and that it is "attracted" out of the developer solution. This is common, and acceptable, terminology. However, it is possibly more precise to say that the toner is electrostatically precipitated, or attracted, out of a developer solution in the presence of a (high voltage) electric field.

The reverse side of the medium that is opposite to its photoconductive surface, and which is typically at ground potential, does not experience a large electric field relative to the side of the slot that it faces, which slot side (or "other electrode") is typically also at ground potential. Neither does this reverse side even have a surface that is capable of holding toner. Accordingly, it remains substantially unaffected by the developer solution, and by the development of the latent electrostatic charge image upon the medium's photoconductive surface.

The quality, and uniformity, of the image that is printed by an electrophotographic imager varies with changes in the concentration of toner within the developer solution. This concentration varies over time as the toner is depleted during use of the imager. The electrophotographic imager is normally adjusted so that, with a fresh batch of developer solution having a maximum concentration of toner, the precise amount of developer solution that is applied to the photoconductive surface will be so as to develop the dots of a halftone image with clarity, and without smearing.

If too much developer solution, or a developer solution of greater than maximum toner concentration, is applied to photoconductive surface then the developed image will not only be excessively dark, but will be fail to be satisfactorily clear and sharp. Conversely, as amount of toner within the developer solution becomes depleted, the black regions of the image generally get lighter over time. Eventually this will cause the image to become unsatisfactory.

The solution to toner depletion has, in the past, been straightforward. Either (i) a complete new batch of developer solution having a full concentration of toner is entered into service periodically, as needed, and/or (ii) the desired concentration of the toner within the developer solution is attempted to be periodically reconstituted by addition of pure, or a high concentration of, toner.

The first approach permits simplicity in the operation of the electrophotographic imager, but demands the periodic replacement of the entire developer solution. The initial concentration of toner relative to liquid carrier within a developer solution is typically less than 1:30, or <3.3%. When the depleted developer solution is replaced the ratio of remaining toner to liquid carrier is typically better than 1:45, or >2.2%. Accordingly, less than about one-half (½) the toner that was originally within the developer solution has been used. The replacement and discard of the depleted developer solution incurs an attendant (i) economic cost, (ii) labor cost and inconvenience, and (iii) environmental impact resultant from the disposition (even through approved channels) of the spent developer solution, which is caustic.

The second approach of periodically replacing lost toner from the developer solution also entails certain costs. Concentrated liquid toner material typically has a sludge-like consistency with a viscosity of 5,000 cps and greater. This material is not easy to handle, nor to dispense with accuracy. If the dispensing of this material is to be precise and reliable, special mechanisms are required. Even it the concentration of toner is maintained within desired ranges for extended periods, the developer solution will, over time, become spent due to the accumulation of contaminants, etc., and must be replaced in its entirety. When it is so replaced the toner is, by operation of the enhancement mechanism, normally at or near full strength. Accordingly, its replacement again entails a waste of toner. Additionally, maintenance personnel must separately provide both toner and carrier solutions (or at least toner and a developer solution) to the electrophotographic imager, compounding the consumable materials handling and storage problems.

One manner of controlling the concentration of toner within a developer solution consisting of toner and a liquid carrier is shown in U.S. Pat. No. 4,119,989 to Carvalko and Tolmie for a SYSTEM FOR CONTROLLING CONCENTRATION OF DEVELOPER SOLUTION. In the Carvalko and Tolmie system a source of light is directed through a developer solution and focused on a photosensor. The photosensor generates an output signal proportional to the light reaching it. Because the toner component of the developer solution is opaque (black) while the carrier component of the same solution is transparent (clear), this signal is proportional to the concentration of toner within the developer solution. The signal is compared to a reference signal that corresponds to a predetermined optimal toner concentration in order to produce an error signal. The error signal is used to modulate the amount of time that a servo mechanism is operated to add toner concentrate to the developer solution, thereby to control the concentration of toner within the developer solution.

Similarly, U.S. Pat. No. 5,003,352 to Duchesne et al. shows an automated system for both (i) controlling toner concentration within a developer solution, and (ii) dispensing the developer solution, within a high speed electrophotographic printing press (operating at speeds of 100 ft./min. and greater). The concentration of liquid toner that is dispersed within a solution of consisting of (i) sludge-like consistency liquid toner concentrate material, and (ii) a liquid carrier, is monitored by an electrical conductivity sensor. This monitoring of electrical conductivity will prove to be similar to the present invention. However, the monitored concentration is again, just as with the system of U.S. Pat. No. 4,119,989 to Carvalko and Tolmie, used to control the flow of the liquid toner concentrate material into the developer solution. The speed of the printing press is also measured, and is correlated with the predetermined optimal flow rate of developer solution to the printing station at different press speeds. The flow rate of the developer solution to the printing station is monitored by a flow meter, and is controlled in a feedback system including logic circuitry and an adjustable flow valve so as to continuously equal the predetermined optimal rate.

According to these problems regarding the formation of quality images in an electrophotographic imager during depletion of the toner within its developer solution; and the cost, complexity and wastage of previous systems for addressing these problems; it would be useful if an improved system could be devised. Such a system would desirably be (i) inexpensively implemented and (ii) simply maintained. It would (iii) continuously produce images of highest quality while (iv) reducing wastage, with its attendant economic and environmental costs, of consumable developer solution (in both its toner and liquid carrier components).

SUMMARY OF THE INVENTION

The present invention contemplates that the rate at which toner is electrostatically precipitated out of a developer solution, and applied to develop a latent electrostatic charge image within an electrophotographic imager, should remain essentially constant regardless that the concentration of toner within the developer solution should vary.

In order to so apply the toner at a constant rate—which is equivalent when an imaged photoconductive medium is moved past a developer station at a fixed speed to maintaining a (i) uniform thickness, and (ii) density, of the applied toner—the present invention contemplates that the strength of the an electric field—in the presence of which electric field toner is electrostatically precipitated out of the developer solution to develop the latent electrostatic charge image—should be varied in proportion to a detected concentration of toner within the developer solution.

This maintenance of a constant toner application rate and, equivalently, this maintenance of a uniform thickness and density of the applied toner—regardless that the concentration of toner within the developer solution should vary over time—is directed to at least two separate purposes. First, the constant toner application rate, and the resulting uniform toner thickness and density of the developed image, uniformly continuously produces a image of highest quality. Second, the present invention (i) simplifies, (ii) extends the interval of, and (iii) reduces the cost and wastage of, developer solution (including contained toner) replacement. In simplest terms, an electrophotographic imager in accordance with the present invention produces a quality image longer for less cost.

In accordance with the present invention, the concentration of toner within a developer solution that includes both a toner and a liquid carrier is continually sensed. The sensing of toner concentration may be performed (i) optically by sensing the light opacity/transparency of the developer solution, (ii) gravimetrically by sensing the density of the developer solution, or, preferably, (iii) electrically by sensing the impedance, and specifically the resistance, of the developer solution. This toner concentration sensing transpires regardless, and independently, that (i) the developer solution may, from time to time, be renewed or replaced, (ii) the toner within the developer solution becomes depleted during use of the imager, and/or (as is not deemed necessary in the system of the present invention, but is not excluded) (iii) the concentration of toner within the developer solution is increased at any time(s) by addition of concentrated toner (necessarily in amount(s) less than that which would cause the resulting developer solution to exceed maximum permissible toner concentration).

The developer solution, of whatsoever presently-existing toner concentration, is applied to the photoconductive surface, bearing the latent electrostatic charge image, of a plate, drum or like medium. This application of developer solution is in the presence of an electric field. It normally transpires at the location of an orifice, normally an orifice in the shape of an elongate slot formed between two plates. The medium having the photoconductive surface passes through the slot. An modest electric field, typically about −25 v.d.c., exists across the slot, and between the two plates. Much more importantly, a strong electric field, typically about −425 v.d.c., also exists between the region the electrostatic charge image upon the medium's photoconductive surface and an opposed one of the plates, which plate forms one long wall of the slot and serves as a prime electrode.

In accordance with the present invention, the strength of the electric field at the location where the toner is electrostatically precipitated from the developer solution, and deposited in a film upon the photoconductive surface of the imageable medium, is proportional to the sensed concentration of toner within the developer. There are at least two ways of varying the strength of the electric field. One way is to dynamically vary the voltage difference between the photoconductive surface's electrostatic charge image and the opposing plate of the slot (the "prime electrode") by varying the voltage potential of either, or of both. Although potentially useful for "fine tuning" the application of toner, this approach offers only a limited range of compensation for variations in toner concentration before complications accrue with the operational voltage range of the photoconductive medium, the effective discharge (marking) of this photoconductive medium with the light beam, and/or the contrast (lack of grey areas) within the developed photoconductive medium.

In accordance with the present invention, the preferred method of varying the strength of the electric field at the location of the developer solution bath, and the application of toner, is to vary the physical separation between the medium's photoconductive surface and the opposed, charged, plate (the "prime electrode"). Normally the separation between two opposed plates is varied; the medium, in passing between the two plates, thus has its photoconductive surface positioned at a greater, or a lessor, proximity to the one plate (the "prime electrode").

The separation between the plates, and between the medium's photoconductive surface and that plate which opposes it (the "prime electrode"), is varied in proportion to the sensed concentration of toner within the developer solution. Moreover, it is so varied in approximately linear proportion to sensed toner concentration. (That the rate of the electrostatic precipitation of toner from out of the developer solution should be proportional to the toner concentration does not preclude that it may also be proportional to other factors such as, for example, the speed of movement of the medium past the developer "bath".) (Notably, the variation in the separation between the photoconductive surface and its opposite plate also varies the thickness, rate and amount of a flowing "sheet" of developer solution that comes into contact with the photoconductive surface. However, it is a narrower separation, which diminishes the total volume of developer solution that comes into contact with the photoconductive surface per unit time, that serves to increase the amount of toner that is electrostatically precipitated from the developer solution per unit time. That is: a lower delivery rate of developer solution to the photoconductive surface actually results in the application of more toner to the latent electrostatic charge image that is upon the photoconductive surface!)

Either manner of controlling electric field strength results in a uniform rate of toner application regardless of, and over a range of, variations in toner concentration. The uniform and even rate of toner application produces an even thickness of toner over the latent electrostatic charge image area, and a uniform density of toner over that area. The preferred control of the electric field strength that is obtained by variation in the separation of two plates, or electrodes, provides excellent compensation for toner concentration variations, typically over a broad dynamic range of at least times two (×2). Because the toner is depleted from the developer solution at an even rate, this same statistic means that the effective life of the developer solution before replacement is extended at least times two (×2). Typically, an electrophotographic imager in accordance with the present invention may start with a developer solution that is somewhat higher in toner concentration than is normal, and subsequently extract almost all of the toner from this the developer solution before its replacement.

The preferred mechanism for varying the electric field during development of the latent electrostatic charge image by application of toner thereto is to move one of the two applicator plates defining the elongate slot relatively closer to, or further from, the other. This movement is by force of a motor, preferably a stepper motor turning a cam. As the toner concentration is sensed to decrease the plates are driven to lessor separation, narrowing the slot and increasing the electric field strength. Commensurate to this increased field strength, the toner is electrostatically precipitated from the developer solution more effectively. Because, however, the concentration of the toner within the developer solution is decreased, the net amount of toner applied to the latent electrostatic charge image areas of the photoconductive medium remains uniformly constant. (The toner concentration does no&. normally increase. However, if it does, such as by refreshment of the developer solution by an addition of toner or toner concentrate, then a sensed increase in the toner concentration will cause the plates to be driven to a greater separation, widening the slot and decreasing the electric field strength.)

These and other aspects and attributes of the present invention will become increasingly clear upon reference to the following drawings and accompanying specification.

DESCRIPTION OF THE PREFERRED EMBODIMENT

Figure 1:
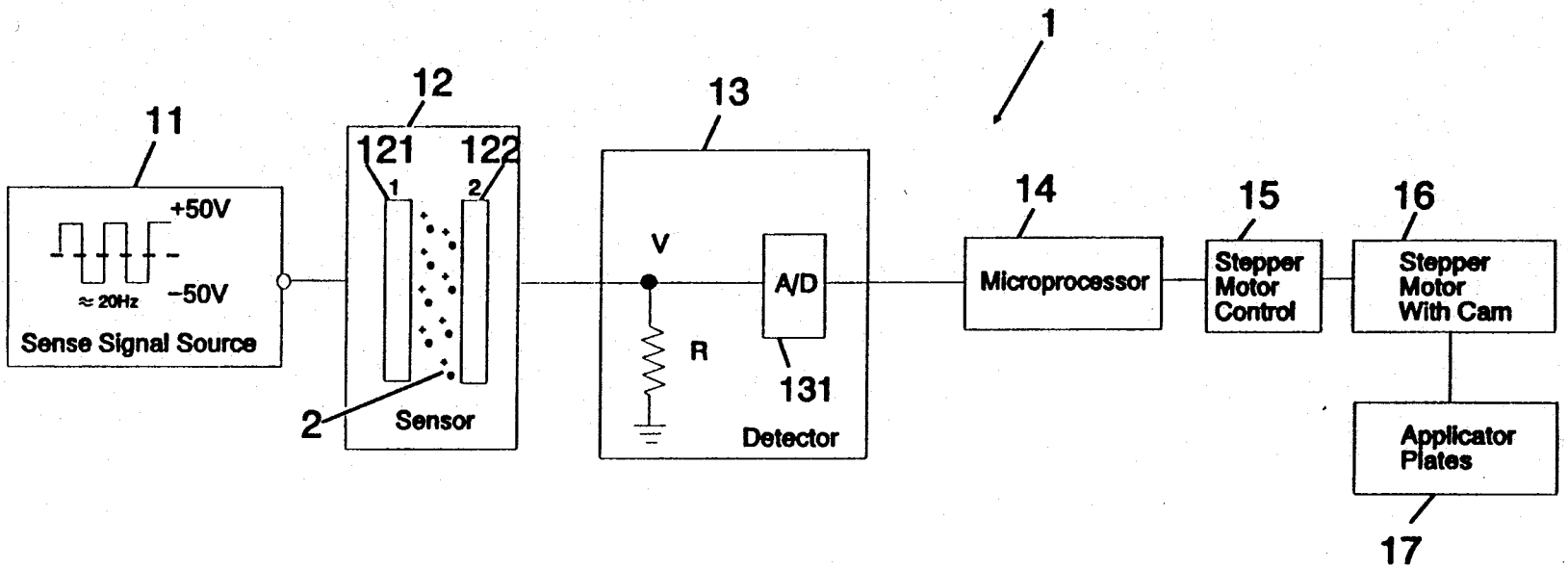
FIG. 1 is a block diagram of a system in accordance with the present invention for the creation of uniform high quality images by varying an electric field, during development of a latent electrostatic charge image with developer solution, in proportion to a sensed concentration of toner that is within the developer solution.

1. The Opacity of a Developed Electrophotographic Image Is Proportional to the Applied Density of Toner Over a Practical Range of Toner Opacities The process of the electrophotographic development of the latent charge image need not, in the real world, physically transpire so that the opacity (blackness), and resolution quality (lack of smearing or voids), in the half-tone dots that are imaged should be roughly proportional to (i) the thickness of the toner film, and (ii) the opacity of the toner. However, for applied toner having a normal and reasonable range of opacity, the resultant image opacity and quality are roughly so proportional to the toner (i) thickness and (ii) opacity. In other words, there is no physical law that mandates that a toner film of thickness X and toner opacity Y should have the same imaging effect as a toner film of thickness 2X and toner opacity ½Y.

However, for toners having a reasonable range of opacity, it has been found that a high image quality image may be maintained simply if the absolute amount of toner applied per unit area of the latent electrostatic charge image is also maintained, insofar as is possible, constant. A typical toner film thickness is about 60 thousandths of an inch (0.0060″). Dependent upon the toner opacity, the imaged medium, the size and density of the desired half-tone dots, etc,. this toner film thickness may typically be variably preset, meaning adjusted, by a factor of at least two times greater (×2, or 0.0120″) or lessor (×½, or 0.0030″) than is the nominal toner film thickness (0.0060″). Whatsoever film thickness is preset for a toner of given opacity and other characteristics, this thickness is desirably maintained plus or minus a few thousandths of an inch (±0.0001 inch) over the entire area of an image, and continuously during the production of many thousands, or tens of thousands, of images.

The requirement that toner application thickness and density should remain constant and invariant has been troublesome when the toner varies in its concentration within a developer solution. The toner typically so varies in concentration due to its depletion from the developer solution during use of the imager. The requirement of constant, and invariant, toner application thickness and density is met by a system in accordance with the present invention.

2. The Resistance of A Developer Solution is Linearly Proportional to the Concentration of Toner Therein It need not be the case in the real world that the electrical resistance of a developer solution containing toner should be in essentially linear proportion to the concentration of toner within the solution. In other words, the relationship between toner concentration and developer resistance could be other than linear. Indeed, in the preferred embodiment of an electrical toner concentration sensing circuit in accordance with the present invention the sensed resistance of the developer solution is received into a microprocessor. This microprocessor could easily account for a non-linear mathematical relationship between sensed resistance and corresponding toner concentration by table look-up or other computations.

Figure 4:
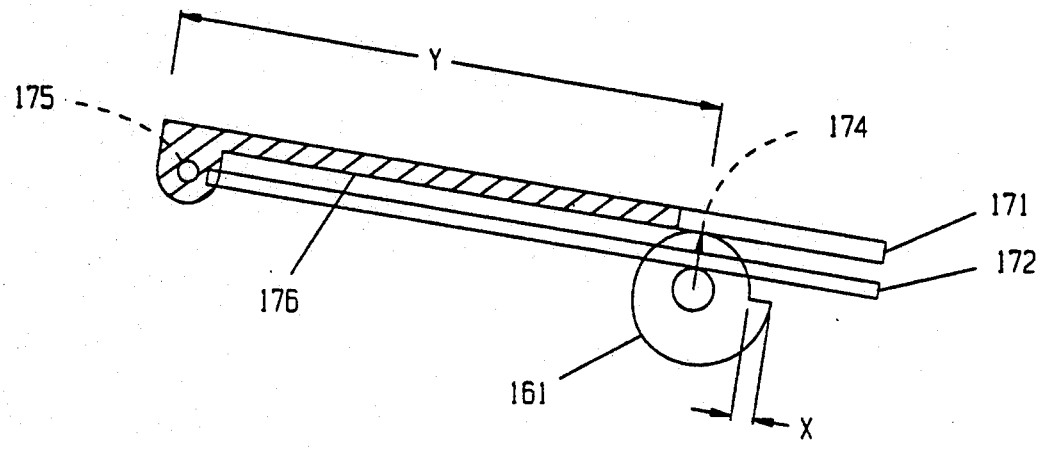
FIG. 4 is a detail diagrammatic view of the manner in which two applicator plates are varied in separation by a pivoting of one plate relative to the other within the preferred embodiment of the system of the present invention.

However, in the real physical world the electrical resistance of a developer solution containing toner happens to be in a highly linear relationship to the concentration of toner within the developer solution, as will be further discussed in conjunction with FIG. 4.

3. According to the Several Linear Relationships, Adjustment and Maintenance of Image Quality Within an Electrophotographic Imager in Accordance with the Present Invention is Precise According to the linear relationship between sensed developer resistance and toner density, and the desired uniformity of toner application density and toner film thickness during application of toner to develop a latent electrostatic charge image, the entire imaging control effected by the present invention is highly linear, and regular.

This linearity means, in particular, that an electrophotographic imager operating in accordance with the present invention may be adjusted, or aligned, so as to produce a quality half-tone image at any time, and with any existing toner (including toners varying in opacity and other qualities) and/or toner concentration (within ranges). The adjustment is simply a matter of determining the baseline spacing between a prime electrode and the medium's photoconductive surface (i.e., the thickness of the slot). By this adjustment the nominal thickness of toner film that is to be applied to develop a latent electrostatic charge image is predetermined for one, present, set of conditions. One this adjustment is made—and it may normally be made both exactingly and well in accordance with the precisely moveable plate(s) and precisely adjustable slot of the imager in accordance with the present invention—then an imager employing the system of the present invention will continue to produce a superb quality image even though the concentration of toner within the developer should, over time, vary greatly.

This ability to adjust the electrophotographic imager to any particular toner is unusual. Electrophotographic imagers of one manufacturer will generally work to some extent with the toner, or developer solution, of another manufacturer. However, the image produced is typically inferior, being either too light or too dark. In accordance with the ability of a system in accordance with the present invention to continually apply a variably predetermined thickness (i.e., density) of toner film to a latent electrostatic charge image for the development thereof, a broad range of toners varying in opacity, particulate size, electrical conductivity and other factors can used to satisfactorily produce images of high quality in the same imager.

4. The Operational Life of the Developer Solution is Extended

As well as maintaining a quality image, an electrophotographic imager in accordance with the present invention is economical, and ecologically conservative, in its consumption of both toner and developer solution. No more (nor any less) toner is ever used in imaging than is precisely appropriate. More importantly, the usable life of the developer solution is extended because an imager in accordance with the present invention may reliably operate with a developer solution having a toner concentration that is much, much less than is normal. A toner-depleted developer solution may typically be used well, typically at least two times (×2), beyond the time that it would normally have been discarded. Extension of the usable life of the developer solution saves both expense and the stress on the environment form disposal of this solution, which is mildly caustic.

5. The System of the Present Invention Is For Varying the Electric Field, During Application of Developer Solution so as to Develop a Latent Electrostatic Charge Image, in Proportion to a Sensed Concentration of Toner That is Within the Developer Solution A block diagram of a preferred embodiment of a system in accordance with the present invention for varying an electric field, during application of developer solution to develop a latent electrostatic charge image, so as to be in proportion to a sensed concentration of toner that is within the developer solution is shown in FIG. 1.

The control system 1 of the present invention includes a sub-system for sensing a concentration of a toner within a developer solution that includes both toner and a liquid carrier. The preferred embodiment of this subsystem is based on electrical resistance (alternatively: conductivity) sensing of toner concentration. It includes a SENSOR SIGNAL SOURCE 11, a SENSOR 12, and a DETECTOR 13.

The SENSOR SIGNAL SOURCE 11 applies an excitation waveform, normally an alternating current voltage waveform of 100 volts peak-to-peak amplitude at a frequency of approximately 20 Hertz, to the developer solution 2. The application is by a first electrode 121 of the SENSOR 122. In accordance with the electrical resistance (conductivity) of the developer solution 2, an a.c. voltage waveform of reduced amplitude will appear at the second electrode 122 of SENSOR 12. This voltage V is stepped down in precision resistor R and applied to A/D (analog-to-digital) converter 131 within the DETECTOR 13 in order to produce a digital quantity representative of the resistance (conductivity), and therefore the toner concentration (as will be further discussed in conjunction with FIG. 3) of the developer solution 2.

It will be understood by a practitioner of the chemical concentration measurement art that the concentration of toner within the developer solution 2 could have been sensed by other than electrical means. For example, toner concentration could be sense optically by the varying transmission of a light beam through the developer solution 2. For example, toner concentration could be sensed gravimetrically by the varying density of the developer solution 2. Still other avenues of sensing concentration, such as, for example, the use of tracers are possible. These alternative means of sensing concentration are compatible with the system of the present invention.

The remainder of the developer density control system 1 is a sub-system for controlling that the electric field strength at which the liquid developer solution is applied to a medium should be proportional to the sensed concentration. The preferred embodiment of this sub-system is based on physically controlling the separation of two opposed plates between which plates a developer solution is applied to a latent electrostatic charge image in order to develop the image. Resultantly to this control of the separation of the two plates, (i) the proximity of the medium's photoconductive surface to a one plate, (ii) the strength of the electric field between that plate and the photoconductive surface, and (iii) the thickness and density of the applied toner film are also controlled. In particular, the (iii) the thickness and density of the applied toner film are typically held constant.

The preferred sub-system includes a MICROPROCESSOR 14, a STEPPER MOTOR CONTROL 15, a STEPPER MOTOR W/CAM 16, and APPLICATOR PLATES 17.

Figure 5:
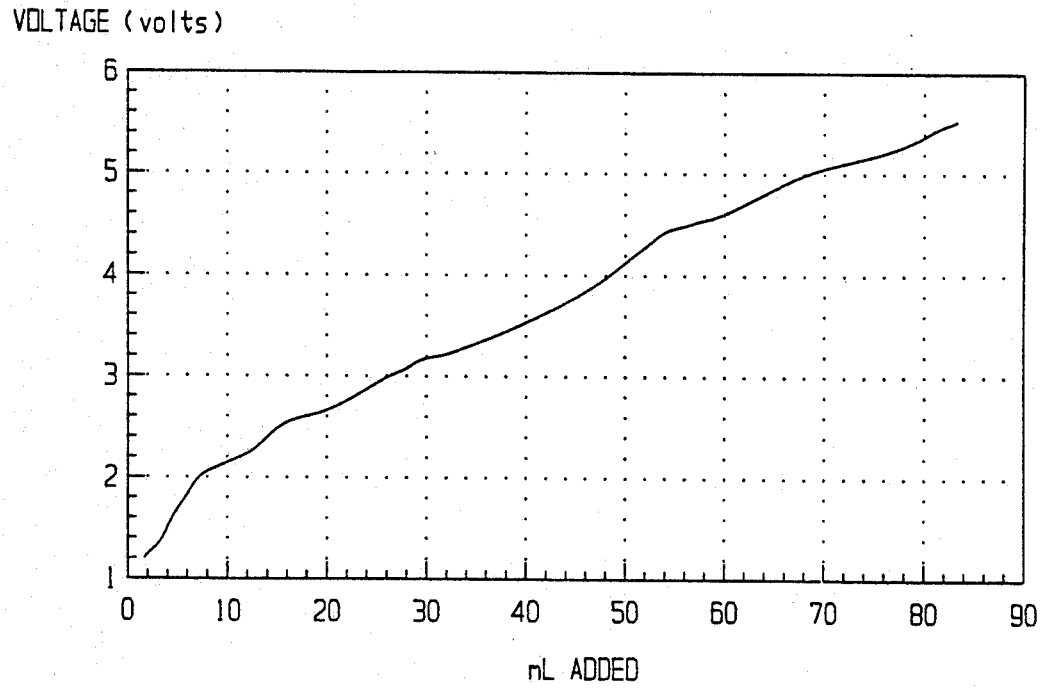
FIG. 5 is a graph showing a relationship between the electrical resistance of a developer solution versus the concentration of toner that is within the developer solution.

The MICROPROCESSOR 14 implements the firmware program flow charted in FIG. 5. It essentially translates the digitally sensed toner concentration into the required drive of the STEPPER MOTOR CONTROL 15. The STEPPER MOTOR CONTROL 15 in turn drives the STEPPER MOTOR W/CAM 16 so as to vary the separation of the APPLICATOR PLATES 17.

Just as with the possibility of alternative embodiments of the concentration sensing sub-system, so also is it possible to vary the electric field where the developer solution is applied to develop the latent electrostatic charge image in several different ways. It is not necessary to vary the width of a slot (defined between APPLICATOR PLATES 17) through which the medium passes in order to vary the electric field. One alternative way to vary the electric field is, for example, to change the electric potential applied between any of the two plates and the photoconductive surface. Another alternative is superimpose an external electric field. These alternatives are, in general, limited in their ability to encompass a broad range of changes in toner concentration. Accordingly, they are not the preferred manner of varying the strength of the electric field at the location of the developer solution "bath", and at the point of the application of the toner film to develop the latent electrostatic charge image.

Figure 2:
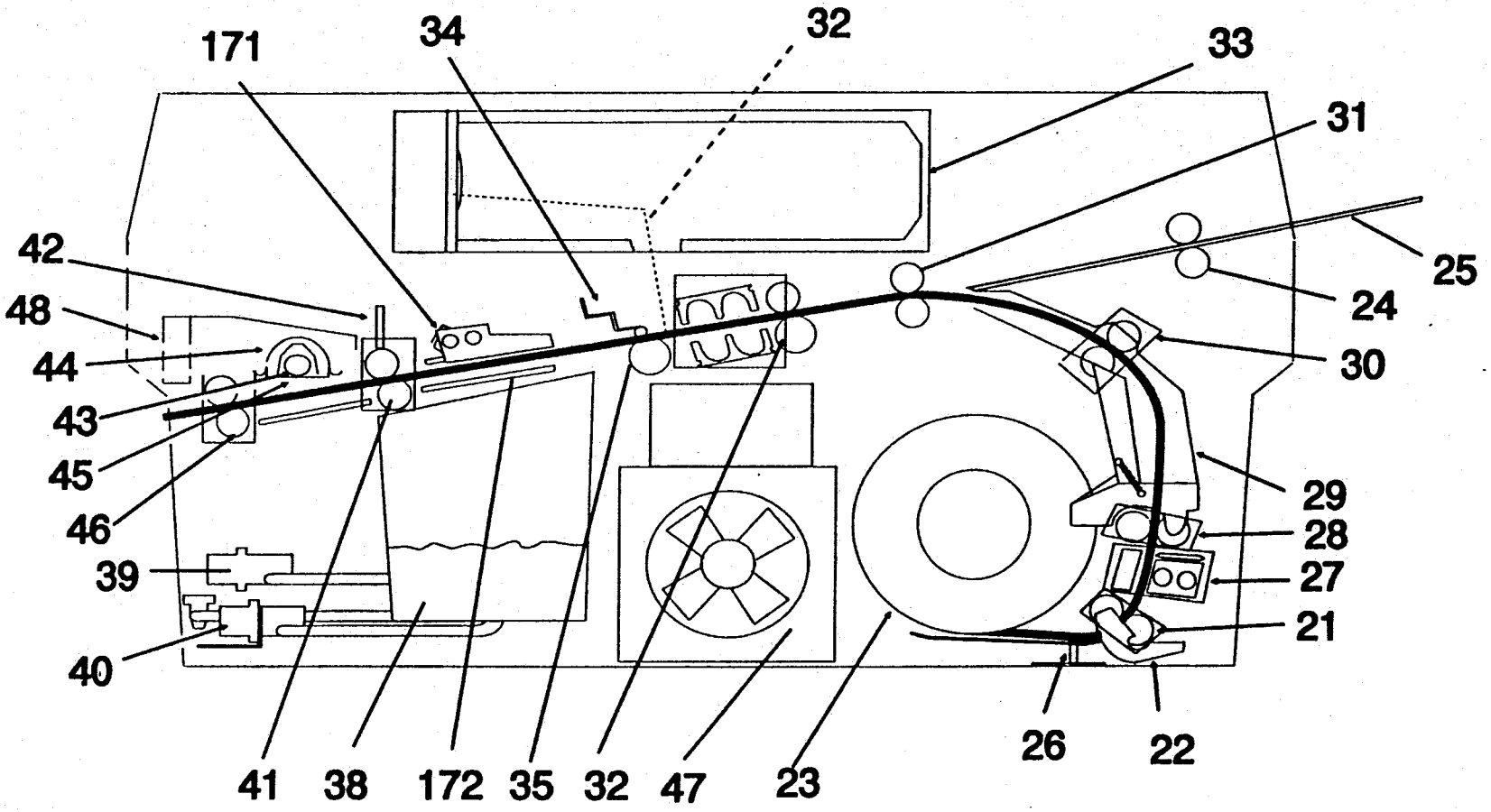
FIG. 2 is a diagrammatic plan view of an electrophotographic imager equipped with the system of the present invention.
Figure 3:
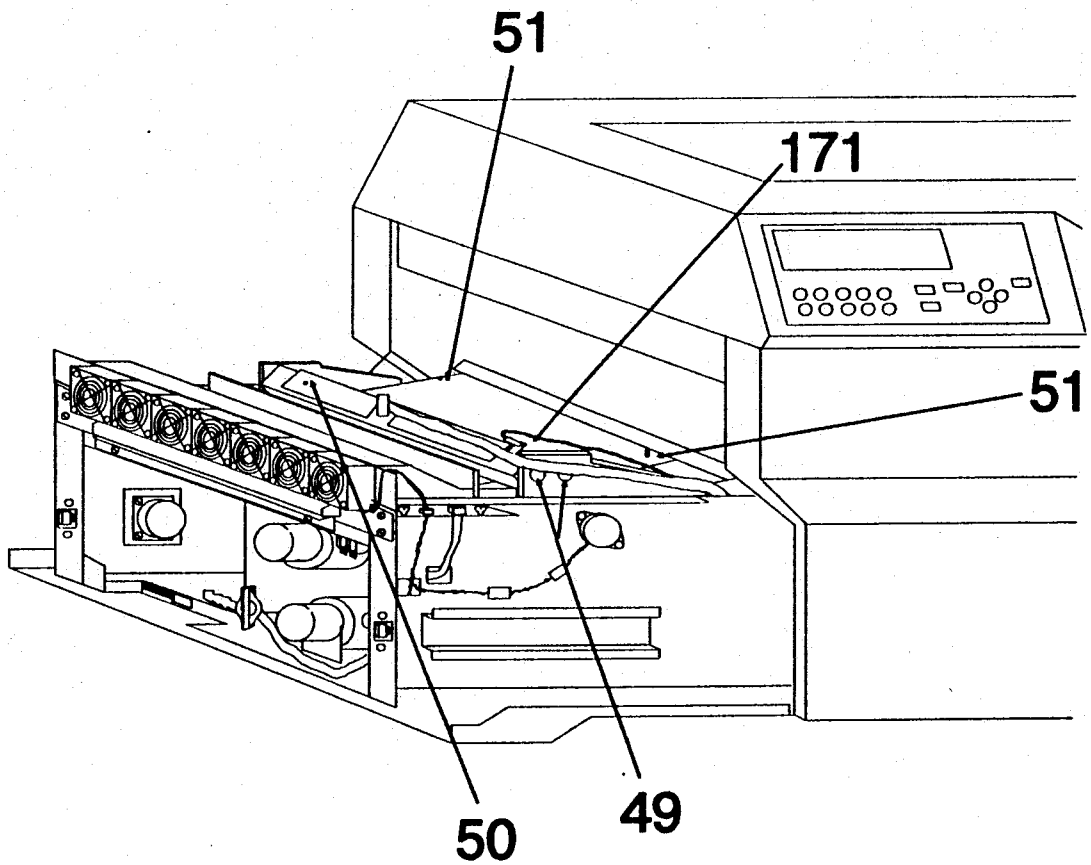
FIG. 3 is diagrammatic perspective view of the electrophotographic imager previously seen in FIG. 2 with a chassis extended in order that the applicator plates (shown in FIG. 1) of the system of the present invention may be more clearly observed.

6. The Uniform Thickness of the Application of Toner to a Latent Electrostatic Charge Image is Determined, and Maintained, In the System of the Present Invention by the Variable Separation of Two Plates A diagrammatic plan view of an exemplary electrophotographic imager that is equipped with the system of the present invention is shown in FIG. 2. A diagrammatic perspective view of the same electrophotographic imager, this time with a chassis extended in order that the APPLICATOR PLATES 17 (previously shown in FIG. 1) of the system of the present invention may be more clearly observed, is shown in FIG. 3.

In operation of the electrophotographic imager, and with particular reference to FIG. 2, an externally-generated print job command is received. Plate infeed rollers 21—maintained in position by a release lever 22—pull roll medium (not shown) off a plate material roll 23 or else decurl rollers 24 straighten sheet material (not shown) received via load slide 25. A plate guide 26 guides the movement of the roll medium (not shown). When an appropriate length of the roll medium has been fed by the plate infeed rollers 21, a sheet is cut by cutter assembly 27. Each and each resulting sheet is fed further onwards by feed rollers 28, transfer plate assembly 29, and transfer rollers 30. Finally the marker transport rollers engage and pull the plate material (not shown) toward the charge coronas 32.

When the plate material (not shown) passes through the charge coronas 32 a negative electrical charge is placed on its side that is to be imaged. A laser light beam 32 (shown in dotted and dashed line for being physically intangible) that is produced by marker unit 33 strikes the plate material below the aperture 34. The plate material (not shown) is selectively discharged in the areas exposed by the laser light 32. The laser "writes white".

The exposed plate material is fed onwards by marker transport rollers 35. As the plate material passes between the top applicator plate 171 and the bottom applicator plate 172 a developer solution containing toner from developer/toner reservoir 38 is applied in a developer/toner "bath". The liquid developer/toner is flow communicated (by a conduit not shown) to this area under force of developer/toner pump 39. Meanwhile, the uniformity of the mixture of toner and liquid carrier is assured by agitator pump 40. The toner particles within the developer solution are subject to the electric fields of the applicator plates 17 (consisting of top applicator plate 171 and bottom applicator plate 172) and the electrostatically charged photoconductive surface of the medium (not shown). Responsively to these electric fields, particles of toner are attracted, or electrostatically precipitated, out of the mixture of the developer solution, and are attracted to those undischarged, latent electrostatic charge image, areas of the medium's photoconductive surface that have retained a large negative electrical charge.

The squeegee rollers 41 and squeegee wiper bar 42 remove excess developer solution—depleted in toner by action of the adherence of a portion thereof to the plate material—from the plate material and recycle it back to developer/toner reservoir 38. A hot fuser bulb 43 is partially shielded by air baffle 44 and fuser guard 44. Its directed energy serves to fuse the toner to the plate material, and to dry the plate material. The dried and fused plate material then exits the electrophotographic imager through the exit rollers 46. Necessary air circulation for cooling is maintained by main fan 47 and a number of exit fans 48.

With particular reference to FIG. 3, the top applicator plate 171 of importance to the present invention is shown therein in greater detail. Applicator bracket screws 49 hold a bracket which, in turn, holds an "L"-shaped guide bar (not shown). A pivot mounting 175 (shown in FIG. 4) for the top applicator plate 171 is further held by hand-adjustable knurled developer/-toner flow adjusting screws 50. These adjusting screws 50 serve to bias the top applicator plate 171 to an adjustably predetermined degree of separation from the bottom applicator plate 172 (shown in FIG. 2). The bottom applicator plate 172 (shown in FIG. 2) is held in fixed position by pins 51, (shown in FIG. 3) and is capable of being detached for The detail manner by which the top applicator plate 171 and the bottom applicator plate 172 are varied in separation is diagrammatically illustrated in FIG. 4. FIG. 4 illustrates a particular, preferred, embodiment. However, a practitioner of the mechanic arts will recognize that either, or both, applicator plates 171, 172 may pivot, or otherwise move relative to one another, in order to vary the slot formed therebetween. The relative movement of the applicator plates 171, 172 may be realized in several different manners, and by diverse actuation mechanisms.

In the particular embodiment shown in FIG. 4 a cam gear 161 (part of STEPPER MOTOR W/CAM shown in FIG. 1) is rotated in position by a stepper motor (not shown, also part of STEPPER MOTOR W/CAM shown in FIG. 1). The variable rotation of the cam gear 161 varies the separation of the APPLICATOR PLATES 17 consisting of top applicator plate 171 and bottom applicator plate 172. The separation is normally variable over a range at least as great as two times (×2) greater than a typical minimum separation of 180 thousandths of an inch (0.0180"). Accordingly, the base circle of the cam gear 161 is nominally two thirds of an inch (0.66") while the distance X, or rise of the cam, is nominally one hundred and eighty thousands of an inch (0.180") over two hundred and seventy degrees (270°). The mechanical advantage of such a cam gear 161 is, by well-known formula, approximately 8.64:1. The force required to force the plates 17 to separation is one pound (1 lb.) minimum. Solving for the required torsion of the STEPPER MOTOR (shown W/CAM in FIG. 1) by well-known formula, a minimum required torque is 0.61 ounce inches (0.61 oz. in.). This may be adequately met, for example, by a type M82101-P2 STEPPER MOTOR (shown W/CAM in FIG. 1) producing 1.3 oz. in. torque in each 7.5° step. This particular STEPPER MOTOR requires 12 volts, 110 ohms/phase, 220 milliamperes of electrical energization.

The moment arm distance Y of the cam contact point 174 (an imaginary point) relative to pivot axis 175 (an imaginary line) is typically three and one-half inches (3.5"). The top applicator plate 171 is not itself this long, being approximately one and one-half inches (1.5 inches) in this direction, but is extended by a lever arm 176 that is to the sides of the top applicator plate 171, and which does not interfere with the movement between this top applicator plate 171 and the bottom applicator plate 172 of the medium (not shown). According to this approximate three and one-half inch (3.5") lever arm length, and the very low angle of rotation, the plates 17 are maintained approximately parallel during all pivoting movement, and relative distances of separation.

7. The Electrical Resistance of the Developer Solution is Proportional to the Concentration of Toner Therein A graph showing a relationship between the electrical resistance of a developer solution versus the concentration of toner that is within the developer solution is contained within FIG. 4. The vertical axis shows the root mean square (r.m.s.) alternating current (a.c.) voltage detectable at the plate 122 of SENSOR 12 (shown in FIG. 1) in response to an excitation voltage waveform of 100 Volts peak-to-peak amplitude and 50% duty cycle at the plate 121 of SENSOR 12 (shown in FIG. 1). The horizontal axis shows the amount of one type of toner that has been added to 1 liter (1000 milliliters) of 100% pure isopar liquid carrier.

Notably, the detectable voltage is not zero even when no toner is present in an ersatz "developer solution". The normal concentration of toner in a new developer solution is approximately 1/30, or 33.3 ml per 1000 ml. The variation in detected voltage both above, and particularly below, this point with varying toner concentration is substantially regular, and linear. Accordingly, a properly calibrated system is able to use the sensed resistance of a developer solution containing toner as an accurate indication of the amount of toner contained therein over a range of at least two to one (2:1), or a toner concentration as low as 16.15 ml per 1000 ml.

Figure 6:
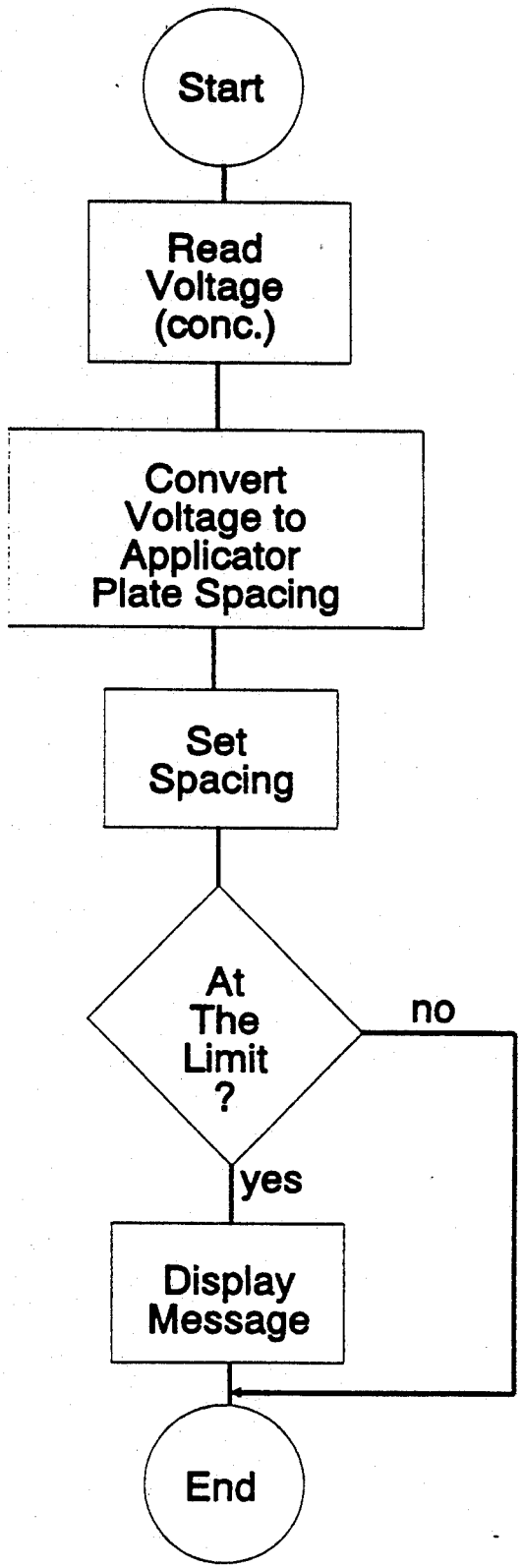
FIG. 6 is a flow chart of a firmware program executed by a microprocessor (shown in FIG. 1) within the electrophotographic imager in accordance with the present invention, the program execution being so as to control the separation of two plates, and the resultant electric field strength therebetween, at a location where a developer solution is applied to a latent electrostatic charge image; the separation being controlled so as to be proportional to a sensed concentration of toner within the developer solution.

8. The Microprocessor Executes a Firmware Program to Control the Separation of the Plates to be in Proportion to the Sensed Electrical Resistance of the Developer Solution A flow chart of a firmware program executed by the MICROPROCESSOR 14 (shown in FIG. 1) within the electrophotographic imager in accordance with the present invention is shown in FIG. 6. The firmware program, which is straightforward in all steps performed, is executed continuously in real time so as to control the separation of the plates 17 (shown in FIGS. 1 and 4). As previously explained, resultant to this separation control of, the proximity of the medium's photoconductive surface to a one plate, the strength of the electric field between that plate and the photoconductive surface is also controlled. By this control of the electric field strength the thickness and density of the applied toner film is maintained constant, and high quality of the image is maintained, despite depletion of toner from the developer solution.

The step "DISPLAY MESSAGE" in the flow chart of FIG. 6 is so as to alert the maintainer of the electrophotographic imager, who has likely not detected such deterioration of image quality as was previously common with depletion of the toner, that the current batch of developer solution is nearing, or has reached, the end of its useful life, and must accordingly be renewed with concentrated toner or, as is preferred, replaced.

Figure 7A:
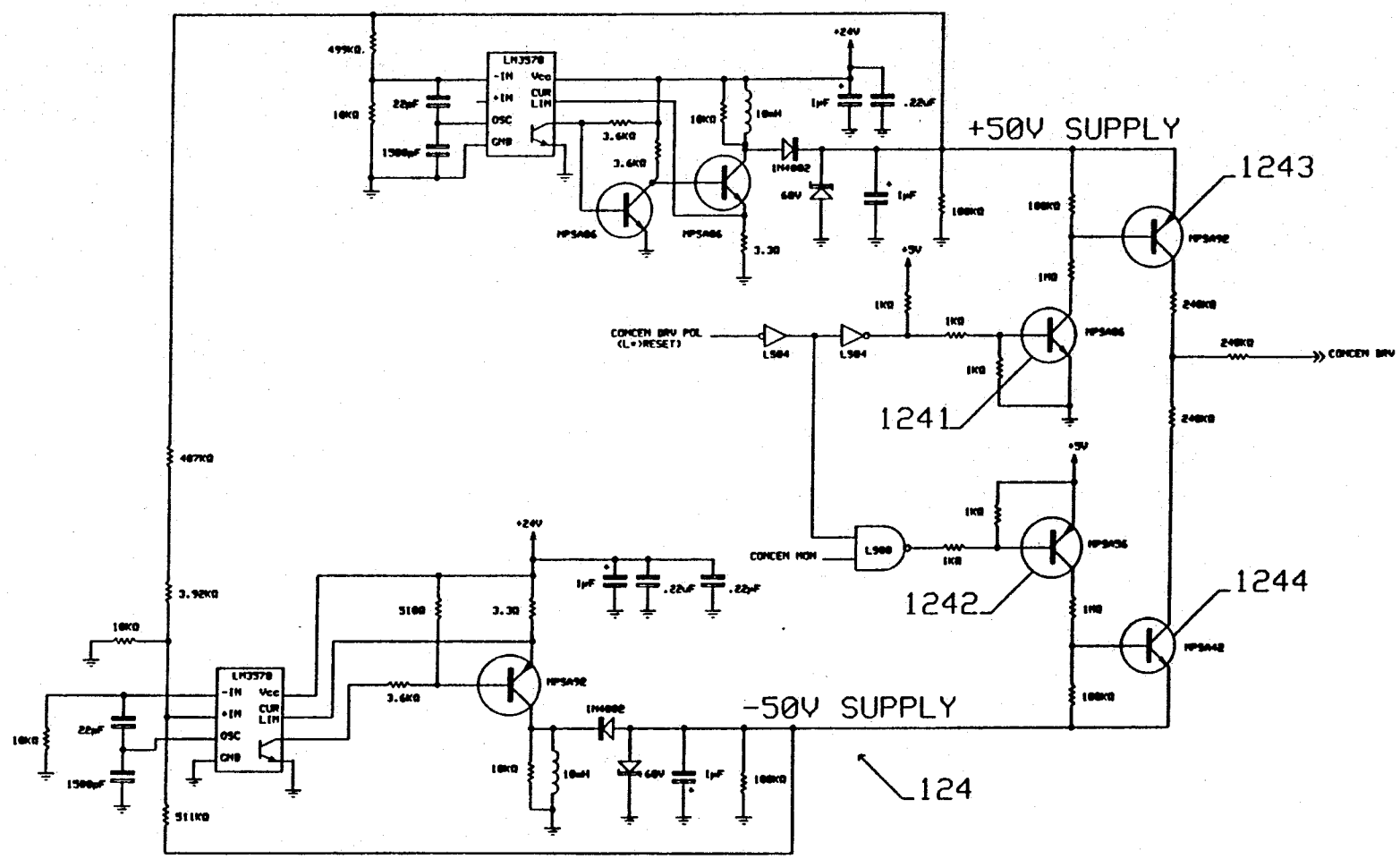
FIG. 7, consisting of FIGS. *7a* and *7b*, is an electrical schematic diagram showing a toner concentration sensing circuit in accordance with the present invention.

9. The Sensor of the Electrical Resistance of the Developer Solution is The Only Custom Electrical Component of the System of the Present Invention An electrical schematic diagram showing a preferred embodiment of a toner concentration sensing circuit in accordance with the present invention is shown in FIG. 7, consisting of FIGS. 7*a* and 7*b*.

Figure 7B:
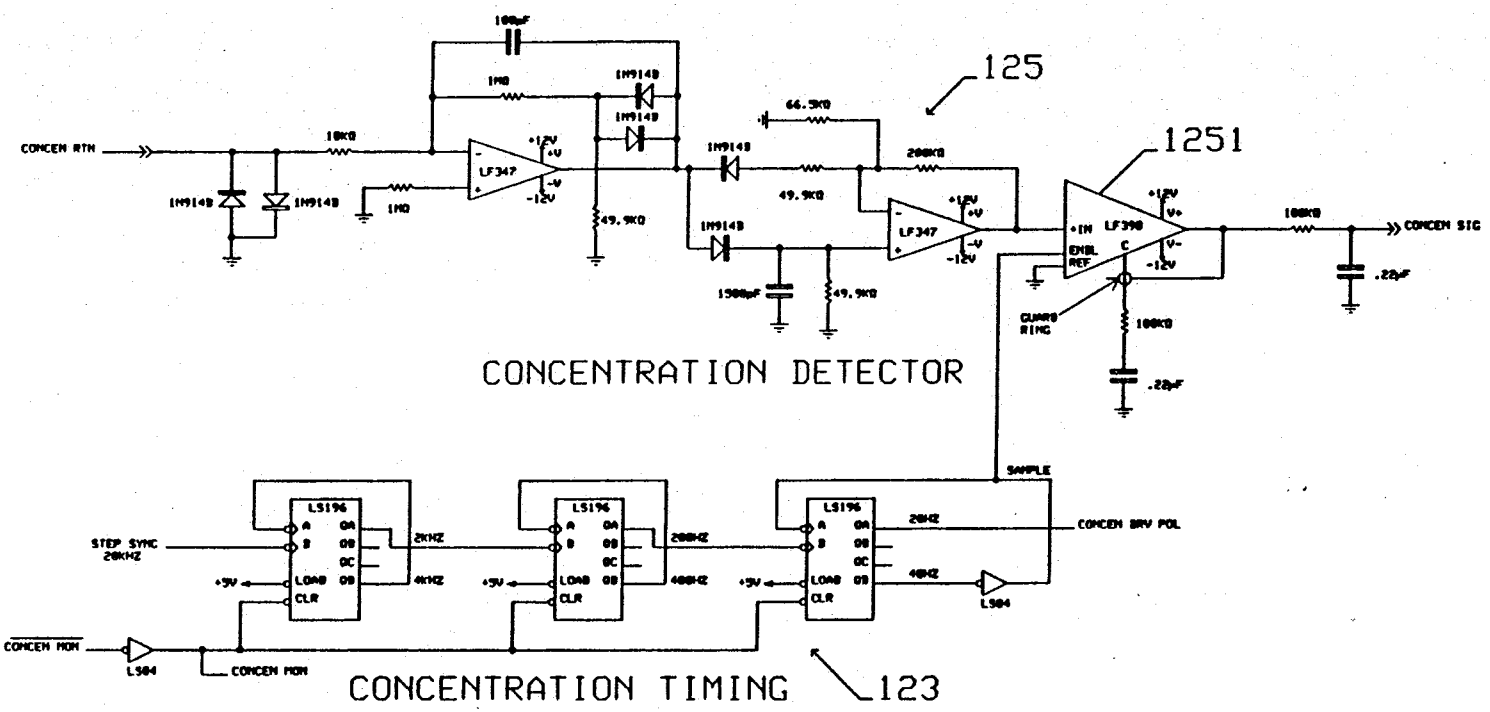

A timing circuit 123 shown at the bottom of FIG. 7*b* successively divides a 20 Khz a.c. signal otherwise available in the electrophotographic imager by a factor of 10 upon three successive times, generating thereby a 20 Hz reference timing signal CONCEN DRV POL. Meanwhile, +50 v.d.c. and a −50 v.d.c. supply signals are developed respectively in the upper, and the lower, legs of the driver circuit 124 shown in FIG. 7*a*. The 20 Hz reference timing signal CONCEN DRV POL is applied in normal, and inverted, form to respective control transistors 1241 and 1242, and used to gate current alternatively through respective power driver transistors 1243 and 1244. Accordingly, the output signal CONCEN DRV is a 100 volt peak-to-peak amplitude alternating current square wave of 20 Hz frequency. This signal is applied to the excitation electrode 12 (shown in FIG. 1) within the developer/toner reservoir 38 (shown in FIG. 2).

The sense electrode 122 of the SENSOR 12 (shown in FIG. 1) produces the signal CONCEN RTN which is received into the concentration detector circuitry 125 shown at the top of FIG. 7*b*. After transimpedance amplification of the signal CONCEN RTN (meaning that the current of the signal is increased, but that its voltage need not be, and likely is not, increased), the signal is gated in sample and hold circuit 1251 by the positive-going half of reference timing signal CONCEN DRV POL. The resultant output signal CONCEN SIG is a d.c. signal the dynamic range of which is compatible with A/D converter 131 (not shown in FIG. 7*b*, shown in FIG. 1), and the magnitude of which is indicative of the sensed concentration of toner within the developer solution.

10. Variations and Adaptations of the System of the Present Invention Are Possible In accordance with the preceding discussion, many possible alterations and adaptations of the system and method of the present invention will suggest themselves to a practitioner of the electromechanical control arts.

For example, once it is recognized that precipitating toner relatively faster (or slower) from a developer solution in the developer bath of the exposed electrophotographic image can compensate for a relatively lessor (or greater) concentration of toner within the developer solution, then it is obvious to attempt various methods, and mechanisms, both to (i) sense toner concentration, and (ii) deliver a constant amount of toner from the developer solution to the latent electrostatic charge image. Some of these alternative methods, and mechanisms, have already been discussed.

An alternative sensing scheme to directly sensing toner concentration might involve, for example, indirectly sensing toner concentration. A reference grey tone band produced upon the image from a varying, or even a constant, delivery of developer might be sensed. Resultantly to the sensing a signal could be produced which would be fed back in order to control the amount and/or rate of toner application to the latent electrostatic charge image upon the medium's photoconductive surface.

An alternative scheme to varying the electric field strength at which toner is applied to the material's photoconductive surface might involve, for example, extending the period of time or times during which the developer solution, and the toner, is subject to the electric field. A developer solution weak in toner will take longer to build up the same thickness of applied toner at a constant electric field strength than will a developer solution containing a high concentration of toner. Accordingly, if the electric field is not increased then the time (which, in an electrophotographic imager, is equivalent to distance along the path of the imaged media) during which development transpires should be increased. This might be accomplished, for example, by selectively bring supplemental "prime" electrodes into proximity to the latent electrostatic charge image upon the medium's photoconductive surface. Effectively, the width of the slot along the path of the medium's movement is being increased. The variation in the electrical field that would be so realized is a variation in the spatial extent of the field, and not (primarily) in its intensity, or strength. Accordingly, the "varying" of an electric field (in proportion to sensed toner concentration) within the present invention must be broadly interpreted.

Finally, the system of the present invention holds out the potential that an imager, operating at least partially under the control of MICROPROCESSOR 14 (shown in FIG. 1) may execute new, and heretofore unknown, commands of the nature of "PRINT LIGHTER" or "PRINT DARKER". An imager is normally adjustable, but not may not normally be commanded, to vary the light/dark characteristics of its produced images. Upon receipt of such commands (directly of indirectly) by the MICROPROCESSOR 14 (shown in FIG. 1) of the system of the present invention, it is a simple matter for the MICROPROCESSOR 14 to bias the APPLICATOR PLATES 17 (shown in FIG. 1) to lessor or greater separation, therein to respectively produce a relatively darker, or relatively lighter, image.

In accordance with these and other possible variations and adaptations of the present invention, the invention should be interpreted broadly, and in accordance with the following claims, only, and not solely in accordance with that particular embodiment within which the invention has been taught.

What is claimed is:

1. An imaging device comprising:

means for sensing a concentration of a toner within a developer solution including a toner and a liquid carrier; and means for varying an electric field, in which electric field the toner is applied develop a latent electrostatic charge image upon a photoconductive medium, in proportion to the sensed concentration, the means for varying the electric field including an electrode charged to a different electrical potential than is at least a portion of the photoconductive medium; and means for varying the distance of separation between the electrode and the photoconductive medium, therein to vary the strength of the electric field therebetween;

wherein the toner is electrostatically precipitated from the developer solution so as to become applied to the latent charge image upon the photoconductive medium in a volume located between the electrode and the photoconductive medium, and is subject during this application to the electric field.

2. The imaging device according to claim 1 wherein the means for sensing comprises:

electrical means for electrically sensing the resistance of the developer solution as an indication of the concentration of a toner therein.

3. The imaging device according to claim 1 wherein the electrode comprises:

a first plate; and wherein the means for varying the distance of separation comprises:

a second plate relative to which the photoconductive medium is positioned; and mechanical means for varying the first plate and the second plate in their distance of separation.

4. The imaging device according to claim 3 wherein the mechanical means comprises:

a cam for camming the first and the second plate to a variable distance of separation.

5. In an imaging device applying a toner, which toner is present at varying concentration within a developer solution including the toner and a carrier, to a photoconductive medium in order to develop a latent electrostatic charge image on the photoconductive medium, the improvement comprising:

means for sensing the varying concentration of toner within the developer solution; and toner application control means, responsive to the mean for sensing, for controlling in proportion to the sensed concentration an environment where the toner that is within the developer solution is applied to the latent electrostatic charge image on the photoconductive medium in order to develop the image, this environmental control which is in proportion to the sensed toner concentration being directed to applying a uniform density of toner to the latent electrostatic charge image regardless that the concentration thereof within the developer solution varies; and means for varying the strength of the electric field including an electrode;

power means for charging the electrode and the photoconductive medium to different voltage potentials; and means for varying a distance of separation between the electrode and the photoconductive medium, therein to vary the strength of the electric field therebetween;

wherein the electric field affects the efficacy of the application of the toner from out of the developer solution onto the latent electrostatic charge image on the photoconductive medium and, correspondingly;

wherein the variation of the electric field compensates for any change in the concentration of toner within the developer solution so as to, regardless of such changes, continue to apply a uniform density of toner to the latent electrostatic charge image.

6. The imaging device improvement according to claim 5 wherein the means for sensing comprises:

means for measuring the electrical resistance of the developer solution;

wherein the measured electrical resistance is proportional to the concentration of toner within the developer solution.

7. The imaging device improvement according to claim 5 wherein the means for sensing comprises:

electrical means responsive to an electrically sensed concentration of toner within the developer solution for producing an electrical control signal; and wherein the means for varying the distance of separation comprises:

mechanical means responsive to the electrical control signal for forcing the electrode and the photoconductive medium to varying distances of separation.

8. The imaging device improvement according to claim 7 wherein the mechanical means comprises:

a cam for camming the separation of the electrode and the photoconductive medium relative to each other; and a motor responsive to the electrical control signal for rotating the cam in position.

9. In an imaging device applying a liquid developer solution, which solution includes a variable concentration of toner plus a carrier, to a photoconductive medium so as to develop a latent electrostatic charge image upon the medium, an improvement comprising:

a electrode positioned proximately to the photoconductive medium at a location where the latent electrostatic charge image upon the photoconductive medium is developed by contact with the liquid developer solution;

means for charging the electrode to a different voltage potential than is the latent charge image upon the photoconductive medium; and means for moving the electrode and the photoconductive medium to varying distances of separation;

wherein the strength of the electric field between the electrode and the photoconductive medium varies in accordance with the separation; and wherein the rate of application of the toner from the developer solution onto the latent electrostatic charge image of the photoconductive medium so as to develop this image is proportional to the strength of the electric field between the electrode and the photoconductive medium, and thus to the varying distance of separation..

10. The improvement to an imaging device according to claim 9 further comprising:

means for sensing a concentration of the toner within the developer solution including a toner and a liquid carrier;

wherein the means for moving the electrode and the photoconductive medium to varying distances of separation is responsive to the sensed concentration.

11. The improvement to an imaging device according to claim 10 wherein the means for moving is responsive to move the electrode and the photoconductive medium to varying distances of separation so that the rate of application of the toner from the developer solution onto the latent electrostatic charge image of the photoconductive medium so as to develop this image remains substantially constant despite, and over a range of, actual, and sensed, variations in the concentration of toner within the developer solution.

12. The improvement to an imaging device according to claim 11 wherein the means for moving is responsive to move the electrode and the photoconductive medium to varying distances of separation so that variations in the concentration of toner within the developer solution are compensated for over a range of concentrations spanning a multiple of at least times two.

13. A method of applying toner, the toner being of varying concentration within a liquid developer solution, so as to develop a latent electrostatic charge image upon a photoconductive medium within an electrophotographic imaging device, the toner application method comprising:

sensing the varying concentration of toner within the developer solution;

producing an electrical control signal in response to the sensed concentration of toner within the carrier;

controlling the strength of an electric field, in the presence of which electric field the toner within the developer solution is applied to the medium so as to develop the latent electrostatic charge image, in proportion to the sensed concentration, the controlling the strength of the electric field including establishing the electric field between the photoconductive medium and an electrode; and varying a distance of separation between the photoconductive medium and the electrode in response to the electrical control signal in order to, by this varying of distance, vary the strength of the electric field;

wherein the controlling is so as to maintain the rate of toner application from out of the developer solution, and onto the latent electrostatic charge image in the development thereof, to be constant despite variations in the actual, and sensed, concentration of toner within the developer solution.

14. The method according to claim 13 wherein the sensing comprises:

measuring the electrical resistance of the toner within the medium.

15. The improved method according to claim 13 wherein the electrode is a one of two plates, and wherein the varying comprises:

defining between two plates, one of which is the electrode, an elongate aperture through which aperture passes the photoconductive medium simultaneously that the photoconductive medium is developed by application of the developer solution; and moving the two plates relative to each other in response to the electrical control signal so as to vary the thickness of the aperture between them;

therein by the moving also varying the distance between the one plate that is the electrode and the photoconductive medium;

therein by the moving also varying the strength of the electric field between the one plate that is the electrode and the photoconductive medium.

16. The improved method according to claim 15 wherein the moving of the two plates comprises:

variably separating the two plates by a camming action.

* * * * *